US005131473A

United States Patent [19]

Fischer

[11] Patent Number: 5,131,473

[45] Date of Patent: Jul. 21, 1992

[54] CONTROLLED RATE WELL CEMENTING TOOL

[75] Inventor: Daniel J. Fischer, Vanderbilt, Tex.

[73] Assignee: Mobil Oil Corporation, Fairfax, Va.

[21] Appl. No.: 668,835

[22] Filed: Mar. 13, 1991

[51] Int. Cl.[5] ..... E21B 34/12; E21B 33/13

[52] U.S. Cl. ..... 166/373; 166/152; 166/285; 166/334; 166/386; 251/117

[58] Field of Search ..... 166/334, 332, 373, 285, 166/386, 277, 114, 320, 72, 73, 152, 188; 251/347, 117, 349

[56] References Cited

U.S. PATENT DOCUMENTS

| | | | |
|---|---|---|---|
| 2,109,197 | 2/1938 | Humason | 166/152 |
| 2,549,198 | 4/1951 | Hayward | 251/347 X |
| 2,582,718 | 1/1952 | Ragland | 166/152 |
| 2,703,696 | 3/1955 | Deters et al. | 251/347 X |
| 2,838,283 | 6/1958 | Simmonds et al. | 175/321 X |
| 2,913,053 | 11/1959 | Westbrook | 166/152 |
| 2,944,607 | 7/1960 | Baker | 166/334 |
| 2,955,614 | 10/1960 | Meynig | 251/117 X |
| 3,087,510 | 4/1963 | Normand, Jr. | 251/117 X |
| 4,333,530 | 6/1982 | Armstrong | 166/332 X |
| 4,597,449 | 7/1986 | Keeney | 166/373 |
| 4,678,035 | 7/1987 | Goldschild | 166/332 X |

*Primary Examiner*—Hoang C. Dang

*Attorney, Agent, or Firm*—Alexander J. McKillop; Charles J. Speciale; George W. Hager, Jr.

[57] ABSTRACT

An improved tool for controlling the rate of flow of cement into a well to control the consolidation of a formation is disclosed. The tool comprises a housing, an actuator and a valve member, motion of which is controlled by axial motion of the actuator within the housing. In the preferred embodiment, the valve member includes a fixed size choke orifice which controls the flow of cement into the formation. The tool is operated by lowering it into a well with the valve open, fixing the housing to the casing of the well, pumping cement below the valve, lowering the actuator with respect to the housing to close the valve, and pressurizing the well to force the cement into the formation at a rate controlled by the size of the choke orifice.

20 Claims, 3 Drawing Sheets

CONTROLLED RATE WELL CEMENTING TOOL

FIELD OF THE INVENTION

This invention relates to an improved tool for use in wells. More particularly, this invention relates to a new tool for controlling the rate at which flowable materials are pumped into wells, e.g., at which cement is pumped into an area to be reinforced in a well, thus improving control of the cementing process.

BACKGROUND OF THE INVENTION

It is common practice to "cement" oil and gas wells in unconsolidated or poorly consolidated formations. More particularly, oil and gas are commonly found in porous rock formations through which the oil and gas flows in production of a well. Often these porous formations are not consolidated or are poorly consolidated. Accordingly, it is normal to "case" a well, that is, line it with a continuous steel pipe, and then perforate the pipe in the vicinity of the productive part of the formation. However, this is often not adequate to provide "zonal isolation," that is, to seal the producing part of the well to the casing. Accordingly, it is common to "cement" the well, that is, pump a quantity of cement slurry between the casing of the well and the borehole. Typically the entire annular space between the casing and the borehole is thus filled with cement in this step. When the casing and the cement are subsequently perforated, substantial isolation of the particular zone of the formation to be produced is provided.

It is also well known that wells which have thus been cased, cemented and perforated may sometimes stop producing, or begin to produce undesirable fluids such as water, due to loss of isolation outside the perforation in the casing. Typically, the formation may erode outside the perforations, and collapse, blocking them; in some cases, the cement itself may erode away. In either case, the isolation provided by the cement between different layers of the formation may be lost. It is common in such circumstances to further cement the well and then to further perforate it. However, if a quantity of cement is simply pumped down the well at a high rate, it tends to flow farther into the formation than would be desirable, and to cause further difficulties. The flow rate at which this occurs varies to a considerable degree with formation strength; a loosely consolidated formation will typically be much more readily penetrated by the fast-flowing cement than a "harder" formation. The desired flow rate of the cement into the formation will also vary with pressure in the formation.

As far as the present inventor is aware, there is no particularly pertinent prior art tool addressing this exact problem. While valves placed in the down-hole tool assembly have been used to control the rate of flow of cement into formations, none of these have been positive flow control valves, merely spring loaded ball valves and the like, and none have been fully successful in controlling the rate of flow of cement into formations.

Accordingly, it is an object of the invention to provide a controlled rate well cementing tool, which can be used to deposit a quantity of cement in the well at the desired depth opposite the perforations, and to control the flow of the cement into the formation at a desired rate, in order to deposit it in a particularly desired way.

SUMMARY OF THE INVENTION

This invention satisfies the needs of the art and objects of the invention mentioned above by its provision of a tool comprising a controlled rate valve for controlling the rate at which cement (or any other flowable material) is pumped into a formation. Two embodiments of the valve of the invention are described and claimed herein. In each, a valve member is provided which is positively operated to open and close a large orifice while a small "choke" orifice remains open. The valve member is operated by axial motion of an actuator with respect to a housing. The actuator is moved axially with respect to the housing by lowering the tool string from which the tool of the invention depends. The housing is fixed to the casing of the well by employment of a conventional packer.

While the valve is open, a large quantity of cement is pumped down into the well below the valve member. The valve member is then closed. The well can then be controllably pressurized by pumping fluid, e.g. water, into the well. The small choke orifice in the valve member controls the rate of flow of the pressurizing fluid. This limits the rate at which the cement is pumped into the formation, controlling the disposition of the cement in the formation, while allowing very high pressures needed to force the cement into the formation to be used.

BRIEF DESCRIPTION OF THE DRAWINGS

The invention will be better understood if reference is made to the accompanying drawings, in which.

DESCRIPTION OF THE PREFERRED EMBODIMENTS

As indicated above, it is the primary object of the tool of the invention to control the rate at which cement is pumped from a well into a formation to be consolidated. Several distinct embodiments of a tool for so doing are disclosed in the present application. In each, the tool comprises an actuator which moves axially within a housing which is fixed in a desired position in the well by a "packer". A quantity of cement is disposed beneath the valve member of the tool, and the valve member is closed. However, the valve member has a small orifice or "choke" formed in it. Water or another fluid is then pumped down the well to force the cement through the casing into the perforation. The size of the choke controls the rate at which the water is pumped through the valve member and thus the rate at which cement is forced into the formation.

Figure 1:
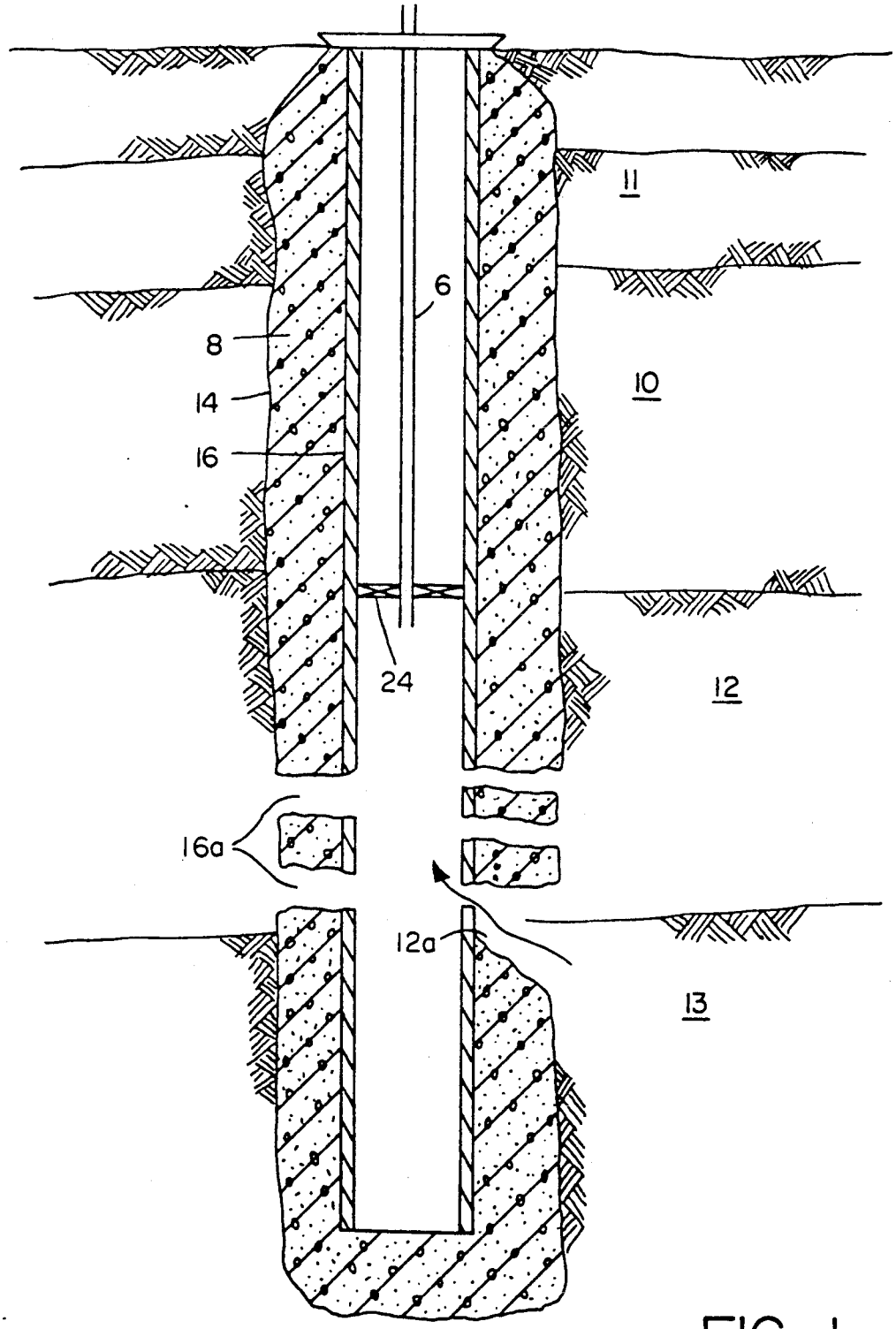
FIG. 1 shows a cross-sectional view of a well drilled in the earth, exhibiting a typical condition to be corrected by employment of the tool of the invention.

FIG. 1 shows a typical well which extends through plural types of rock formations 10, 11, 12 and 13. Rock formation 12 is shown as being generally porous which of course is more productive to oil and gas than is a nonporous formation 10, which traps oil and gas. As is conventional, the borehole 14 is lined by a casing 16 which comprises a number of sections of steel pipe lowered into the hole after the well has been drilled. The casing 16 is cemented to the borehole by a quantity of cement 8. The casing and cement 8 are perforated at 16*a* by explosive devices or the like which in effect punch holes in the casing 16 and cement 8, enabling production of oil from the porous formation 12. The oil and gas produced are brought to the surface by way of a "string" of tubing 6, sealed to the casing 16 by a packer 24.

Commonly, an unconsolidated or poorly consolidated formation will erode to form a void space 12*a*. As shown, the void space 12*a* may allow a porous layer 13 filled with undesired fluid, such as salt water, to communicate with the casing 16 by way of perforations 16*a*. The formation can also collapse, interfering with production of oil and gas from the well. To solve these problems, it is conventional to "squeeze cement" the well by pumping cement slurry out through the perforations, to form a plug between the casing and the formation, which is then reperforated to allow further production. However, as indicated above, no prior art method known to the present inventor exists in which the pumping is controlled by a "down-hole" device at a rate selected in accordance with the bottom-hole pressure and formation strength. If cement is pumped into the well at an uncontrolled rate, it often tends to fail its intended purpose and further interfere with production.

The present invention provides a tool for solving this problem by providing positive control of the rate of flow of cement into the formation. In the first embodiment of the invention shown in FIG. 2, the tool comprises a housing 20, an actuator 22 sliding axially within the housing, and a packer 24. The pacer 24 is fixed to the housing 20. In this embodiment, the tool comprises a valve member 26 which depends from the actuator 22 at a pivot point 28, so as to move between closed and opened positions as the actuator 22 moves axially within the housing 20. The tool is shown with the valve member 26 in the closed position in FIG. 2.

In use, the tool is lowered into the well, supported by a string of tool tubing indicated at 30. The actuator 22 is threaded into the string of tool tubing 30 and comprises a shoulder 22*a* which mates with a comparable shoulder 20*a* on the housing. Thus the housing depends from the actuator. In this circumstance, the valve member 26 hangs beneath the actuator, from the pivot point 28, exposing a relatively large orifice defined by valve seat 20*b* formed on the housing 20.

When the tool reaches the desired depth in the well, that is, opposite the perforations 16*a*, the packer 24 is locked to the inside of the casing 16 in the conventional way, thus fixing the housing 20 to the casing 16. Cement is pumped down the center of the string of tool tubing, and flows into an area within the casing 16, below the packer 24. Normally the casing is full of water, mud and the like, on which the cement rests. If necessary, a conventional "plug" may be disposed in the casing, below the perforations. It will be understood by those of skill in the art that the volume of cement can effectively be controlled by the relative position of the tool with respect to the perforations 16*a*.

When an appropriate amount of cement has been disposed within the casing beneath the tool, the valve is then closed by lowering the actuator 22 depending from the string of tool tubing with respect to the housing 20. This causes the valve member 26 to abut the valve seat 20*b* and pivot to the position shown in FIG. 2, wherein the main opening of the valve defined by the valve seat 20*b* is closed. This leaves open only a restricted area choke orifice 26*a*, formed in the valve member. Water or another fluid is now pumped down the string of tool tubing 30, to force the cement into the formation. The choke orifice 26*a* restricts the rate at which this fluid can force the cement from within the casing 16 out through the perforations 16*a* into the void space 12*a* in the formation. More particularly, the provision of the choke orifice allows very high pressures needed to force the cement into the formation to be employed, while the rate of flow of the cement into the formation is limited. In some cases the weight of the column of fluid may itself provide sufficient pressure to force the cement into the formation.

Figure 2:
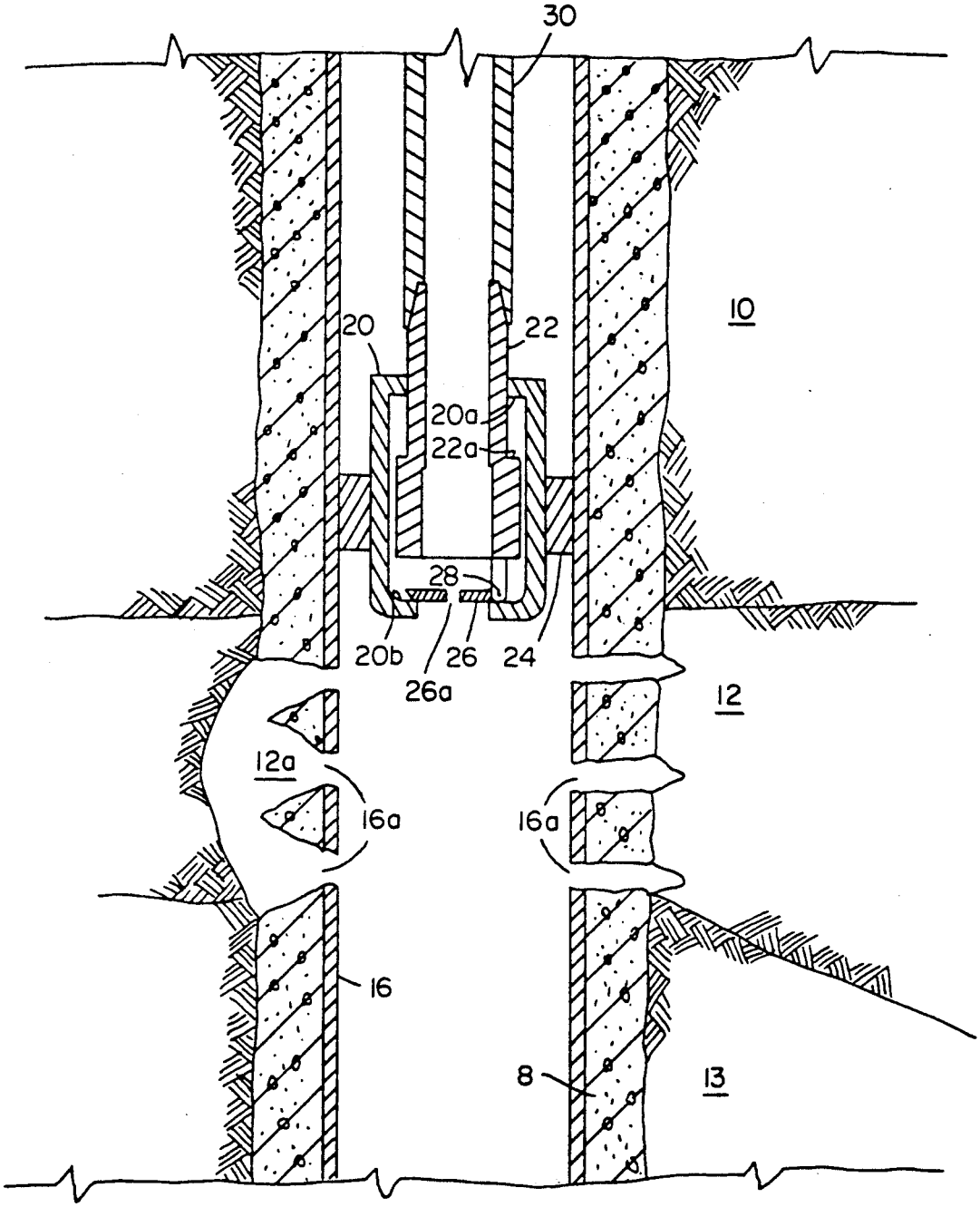
FIG. 2 shows a first embodiment of the tool of the invention, disposed in a typical well environment, with the valve member in the closed position.
Figure 3:
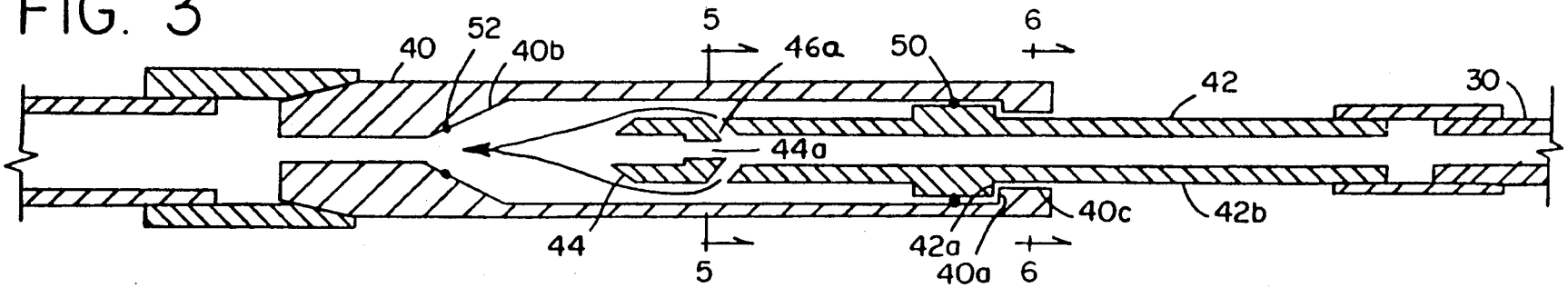
FIG. 3 shows a cross-sectional view of a second preferred embodiment of the invention, with the valve in the open position.
Figure 4:
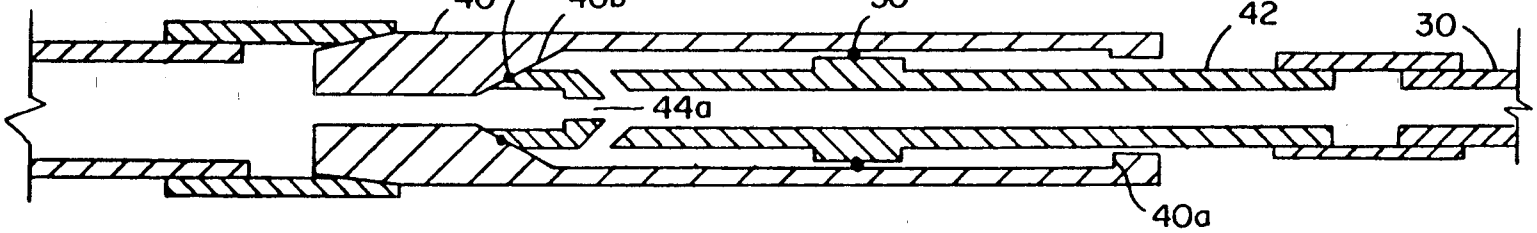
FIG. 4 shows a corresponding view of the valve of FIG. 3 in the closed position.
Figure 6:
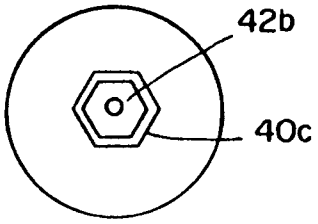
FIG. 6 shows a cross sectional view along the line 6—6 of FIG. 3.
Figure 5:
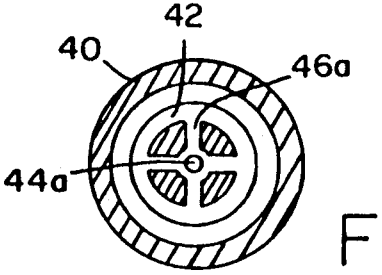
FIG. 5 shows a cross sectional view along the line 5—5 of FIG. 3.

A second embodiment of the invention is shown in FIGS. 3-6. This tool is operated identically to that shown in FIG. 2. FIG. 3 shows the tool with the valve member in the open position, and FIG. 4 shows the valve member closed. FIGS. 5 and 6 are cross-sections along the lines 5—5 and 6—6 respectively of FIG. 3.

As can be seen in FIG. 3, the tool in this embodiment again comprises a housing, in this embodiment numbered 40, and an actuator 42. In this embodiment, however, the valve member 44 is not pivoted on the actuator 42 but is fixed thereto. While the valve is open (FIG. 3) the ends of a number of relatively large orifices 46*a* (see FIG. 5) extending radially between the valve member 44 and the actuator 42 are exposed, so that cement can flow around the valve member and into a lower portion of the string of tubing, as indicated generally by the arrows in FIG. 3. The valve member 44 also has formed therein a restricted area orifice or choke 44*a*. The choke's size may be readily varied by providing it as an orifice in a replaceable member threaded into the valve member 44. The valve is closed, again by fixing the housing to the casing by a packer (not shown) and lowering the actuator with respect to the housing, as described in connection with the embodiment of FIG. 2. The orifices 46*a* are then effectively closed by abutment of the valve member 46 against a valve seat 40*b* formed on the housing, as shown in FIG. 3. The mating surfaces may have corresponding conical shapes. When the well is subsequently pressurized, the restricted area choke 44*a* restricts the flow of the cement into the formation and controls its disposition. O-rings 50 and 52 may be provided to seal the actuator to the housing and the valve member to the seat, respectively.

As indicated above, the operation of the tool of FIGS. 3-6 is essentially the same as that of the FIG. 2 embodiment. The housing is supported by shoulders 42*a* and 40*a* formed on the actuator and housing respectively while the tool is lowered into the well, that is, in the position of FIG. 3. The packer is then fixed to the wall of the casing. A relatively large quantity of cement is then pumped into the casing beneath the tool. The actuator 42 is then lowered further, closing the valve, taking the position of FIG. 4. The well is then pressurized, forcing the cement out through the perforations at a rate responsive to the size of the choke orifice 44*a* and the viscosity of the fluid (typically water) used to pressurize the well. Again, allowing the fluid to pass only through the choke orifice 44*a* allows high pressure to be employed while the flow rate remains low.

In both embodiments of the invention, the actuator is preferably keyed to the housing generally as shown in FIG. 6, that is, by formation of a particular cross sectional shape on the portion of the actuator 42*b* extending out of the housing for connection to the tool tubing 30, and a correspondingly shaped orifice 40*c* on the housing. This prevents relative rotation thereof, and eliminates unthreading of the tool from the string of tool tubing.

Two embodiments of the invention have been disclosed in detail. The embodiment of FIGS. 3–6 appears at present to be more reliable in use than the FIG. 2 embodiment, and thus is the preferred embodiment and represents the best mode of practice of the invention as of the filing date of this application. There are undoubtedly other embodiments of the tool of the invention which fall within the spirit and scope of the invention. For example, the choke could be formed in a portion of the tool other than the valve member itself, as in the two embodiments discussed above. The choke orifice need merely remain open, allowing passage of pressurizing fluid through the tool, regardless of the position of the valve member.

As noted above, the tool is useful for controlling the flow of flowable materials other than cement. By variation of the size of the choke orifice with respect to the viscosity of the fluid used to pressurize the well, flowable materials of varying viscosities and various desired flow rates can be accommodated. Accordingly, the invention is not to be limited by the above preferred embodiments which are exemplary only, but only by the following claims.

I claim:

1. A tool adapted to be mounted on a string of tool tubing for controlling the flow rate of flowable materials in a well cased by a casing, said materials flowing from a position in the well above said tool to a position in the well below said tool and into a formation surrounding said well, comprising:

a housing;

a packer for selectively securing and sealing said housing to said casing at a desired position within the well;

a valve seat within and fixed with respect to said housing and defining a relatively large aperture for flow of said materials therethrough;

a movable valve member, said valve member being mounted for movement between open and closed positions with respect to said valve seat, such that relatively high rate bulk flow of materials through said aperture from a position in the well above the tool to a position in the well below the tool is permitted only when said valve member is in the open position with respect to said valve seat;

an actuator controllably axially movable within said housing in response to vertical motion of said string of tool tubing for controllably moving said valve member between its open and closed positions; and means defining a choke orifice of desired size which remains open, allowing relatively low rate limited flow of materials from a position in said well above said tool through said tool to a position in said well above said tool, regardless of the position of said valve member.

2. The tool of claim 1, wherein said choke orifice is formed in said movable valve member.

3. The tool of claim 1, wherein said movable valve member is mounted o a distal end of said actuator, whereby axial movement of said actuator with respect to said housing moves said valve member between said closed and open positions with respect to said valve seat.

4. The tool of claim 3, wherein during the lowering of said tool into a wellbore, said housing depends from said actuator, which actuator in turn is supported by said string of tool tubing, said valve member then being spaced from the valve seat in its open position, and wherein to close said valve, said housing is fixed in a desired position in the well, and said actuator is lowered with respect to the housing.

5. The tool of claim 3, wherein said valve member comprises a generally radially symmetric body including a first sealing surface for sealing engagement with a second corresponding sealing surface on said valve seat.

6. The tool of claim 5, wherein at least one of said sealing surfaces on said valve member and said valve seat is adapted to retain therein an O-ring for sealing engagement with the other of said sealing surfaces.

7. The tool of claim 5, wherein said valve body has formed therein plurality of further orifices extending therethrough, such that said further orifices are closed when said sealing surface on said valve body engages said sealing surface of said valve seat.

8. The tool of claim 5, wherein said first and second corresponding sealing surfaces are generally conical.

9. The tool of claim 1, wherein said actuator comprises a member which extends out of said housing for connection to the string of tool tubing.

10. The tool of claim 9, wherein the actuator is keyed to the housing for precluding rotation of the actuator with respect to the housing.

11. The tool of claim 9, wherein the member of said actuator which extends out of said housing has a polygonal cross-sectional shape which mates with a correspondingly shaped orifice in the housing to prevent rotation of the actuator with respect to the housing.

12. The tool of claim 9, wherein said actuator comprises an annular step member on its exterior surface adapted to engage a mating annular step member formed on the interior wall of said housing, whereby when said tool is lowered into a well, said step members abut and said actuator supports said housing.

13. The tool of claim 1, wherein said movable valve member is a flapper valve member pivoted with respect to said actuator.

14. The tool of claim 13, wherein said movable flapper valve is disposed beneath said actuator, depending therefrom.

15. The tool of claim 14, wherein said valve seat is formed on said actuator, said actuator being raised with respect to said housing to open said valve and lowered with respect to said housing to close said valve, and wherein said valve seat is formed to comprise an actuating surface, such that when said actuator is lowered, said movable flapper abuts said actuating surface and is pivoted into sealing engagement with said seat.

16. The tool of claim 7, wherein said valve body is a generally elongated member mounted for vertical movement with respect to said housing and said valve seat, and said further orifices in said valve body comprise passages extending through said valve body downwardly from open upper ends to open lower ends, one of the upper or the lower end of each of said passages being formed in said first sealing surface on said valve body, such that said passages are effectively closed by said second sealing surface of said valve seat when said first sealing surface on said valve body engages said second sealing surface of said valve seat.

17. The tool of claim 16, wherein said means for defining a choke orifice of desired size is mounted in a passageway extending through said valve body.

18. A method for controllably supplying a desired flowable material to a particular portion of a formation surrounding a well cased by a casing, said casing being perforated by perforations in the vicinity of said particular portion of the formation, said method comprising the steps of:

lowering a tool mounted on a string of tool tubing into the well, said tool comprising:

a housing adapted to be fixed in a desired position in a well;

a movable valve member, mounted for movement between open and closed positions with respect to a valve seat;

a valve seat for sealing engagement with said valve member when said valve member is in the closed position and defining a relatively large aperture when said valve member is in the open position;

an actuator for controllably moving said valve member between its opened and closed positions, said actuator being operated by movement with respect to said housing after said housing is fixed in a desired position in a well;

means for defining a choke orifice of desired size to allow flow of fluid through said tool regardless of the position of said valve member; and a packer fixed to the housing of said tool;

employing the packer to fix the housing to the casing of the well;

while said valve is in the open position, disposing a quantity of the desired material beneath the tool, in the vicinity of the particular portion of the formation;

closing the valve by moving the actuator with respect to the housing; and pressurizing the well to force fluid disposed in said well above said tool through said choke orifice to urge the desired material to flow through the perforations in the casing and into the formation around the cased well.

19. The method of claim 18, wherein said actuator supports said housing while said tool is lowered into the well, and is lowered with respect to the housing after the housing is fixed to the casing to close the valve.

20. The method of claim 18, wherein said means for defining a choke orifice is part of said valve member.

* * * * *

UNITED STATES PATENT AND TRADEMARK OFFICE

CERTIFICATE OF CORRECTION

PATENT NO. : 5,131,473

DATED : July 21, 1992

INVENTOR(S) : Daniel J. Fischer

It is certified that error appears in the above-identified patent and that said Letters Patent is hereby corrected as shown below:

Column 5, line 63, "above" should read --below--

Column 5, line 68, "o a" should read --on a--

Signed and Sealed this

Thirty-first Day of August, 1993

*Attest:*

*Attesting Officer*

Bruce Lehman

BRUCE LEHMAN

*Commissioner of Patents and Trademarks*